United States Patent [19]

Lewis et al.

[11] Patent Number: 4,523,207

[45] Date of Patent: Jun. 11, 1985

[54] MULTIPLE COPY THERMAL RECORD SHEET

[75] Inventors: Maurice W. Lewis, Dayton; Stephen D. Lakes, West Carrollton, both of Ohio

[73] Assignee: NCR Corporation, Dayton, Ohio

[21] Appl. No.: 480,518

[22] Filed: Mar. 30, 1983

[51] Int. Cl.[3] ..... B41M 5/18

[52] U.S. Cl. ..... 346/214; 156/234; 346/208; 346/221; 346/226; 427/145; 428/913; 428/914

[58] Field of Search ..... 428/913, 914, 195, 204, 428/452, 537, 304.4; 430/343; 427/145; 346/208, 204, 214, 221, 226; 156/234

[56] References Cited

U.S. PATENT DOCUMENTS

| | | | |
|---|---|---|---|
| 3,539,375 | 11/1970 | Baum | 428/913 X |
| 3,561,991 | 2/1971 | Baum | 428/204 |
| 3,674,535 | 7/1972 | Blose et al. | 428/452 |
| 3,859,111 | 1/1975 | Takanishi et al. | 428/913 X |
| 3,916,068 | 10/1975 | Kohmura et al. | 427/145 X |
| 3,984,605 | 10/1976 | Kohmura et al. | 427/145 X |
| 4,123,580 | 10/1978 | Franer | 428/304.4 |
| 4,273,602 | 6/1981 | Kosaka et al. | 428/913 X |
| 4,401,721 | 8/1983 | Hida | 428/913 X |

FOREIGN PATENT DOCUMENTS

| | | | |
|---|---|---|---|
| 120444 | 10/1978 | Japan | 346/204 |
| 1170757 | 11/1969 | United Kingdom | 156/234 |

*Primary Examiner*—Thomas J. Herbert

*Attorney, Agent, or Firm*—Wilbert Hawk, Jr.; Albert L. Sessler, Jr.; George J. Muckenthaler

[57] ABSTRACT

A thermal-sensitive record sheet copy system provides multiple copies by applying a coating to one record sheet. The single coating formulation includes ingredients which react to heat to provide a tacky condition having a desirable adhering property and thereby produce images on the two sheets. The coating includes a binder of synthetic polyterpene in the mixture in combination with a thermochromic dye and a phenolic resin.

10 Claims, 6 Drawing Figures

MULTIPLE COPY THERMAL RECORD SHEET

BACKGROUND OF THE INVENTION

In the field of thermal printing, it is well-known that a significant limitation in the printing operation is the absence of copies during such printing operation. The early thermal printing systems used a thermal print element energized to heat specific and precise areas of a heat-sensitive paper or like record material and thereby produce readable characters on the single sheet of paper. In this respect, the single sheet of paper includes material which is reactive to the applied heat and is described as a self-contained system.

More recently, thermal printing systems have included two separate sheets of paper or like record material, wherein each sheet is coated with a heat-sensitive reactive material. The top or front sheet is usually a light weight tissue-type paper which is coated with the heat-sensitive material and the second sheet is preferably bond-type paper which is also coated with the sensitive material. The two sheets are then mated or collated in a manner wherein the uncoated side of the tissue paper is in contact with the coating on the bond paper. The coated side of the tissue paper is adjacent and in close proximity to the thermal printing elements, or in certain applications, the elements may be in actual contact with the tissue paper. The thermal elements are actuated to provide specific and precise marking or imaging on the papers in the process which enables the obtaining of a master sheet plus a readable copy.

Alternatively, the tissue paper could be coated on both the front and back sides so that the thermal printing elements are adjacent or in contact with the front coated side of the tissue paper and the back coating is in contact with the bond paper. In similar manner, the thermal elements are actuated to provide the specific and precise marking or imaging on the two papers so as to be in readable form. The tissue sheet and the bond sheet are arranged in manifold manner and the imaging is accomplished by transfer of the ink or like material in the coating onto the sheet.

Representative documentation in the field of thermal printing includes U.S. Pat. No. 3,539,375, issued to H. H. Baum on Nov. 10, 1970, which discloses temperature-responsive record material that includes a support sheet having crystal violet lactone and a phenolic disposed in a matrix of polyvinyl alcohol, and arranged such that application of heat will produce a mark-forming reaction between the lactone and the phenolic.

U.S. Pat. No. 3,561,991, issued to H. H. Baum on Feb. 9, 1971, discloses a transfer record sheet for making multiple copies of a single heat impression wherein the translucent support sheet is coated with an ink source that normally is solid at room temperature and meltable to a tacky transfer condition upon application of heat. The melted coating stays in the tacky condition for a period of time to allow the making of a succession of copies upon contact of sheets with the melted image area.

U.S. Pat. No. 3,674,535, issued to J. H. Blose et al. on July 4, 1972, discloses heat-sensitive record material comprising a paper base sheet and a coating of chromogenic material and a bisphenol distributed in a polyvinyl alcohol in combination with a filler, a lubricant and a non-tacky wax.

SUMMARY OF THE INVENTION

The present invention relates to thermal printing anc to an improved system for making an original and a least one copy during the printing operation. Mor particularly, the invention is directed to the use of ar improved coating provided on one record sheet such a paper or the like, and the coated sheet is then mated o collated with an uncoated sheet in a manner wherei the coating material is sandwiched between the sheets In more specific language, the top or front record shee is a tissue or translucent type paper and such sheet i coated with the improved thermochromic or heat-sensitive material on the back side thereof, which material i in contact with the front side of the rear record sheet preferably a bond or like paper. The two sheets are imaged by use of thermal printing elements being placed in extremely close proximity or in actual contac with the uncoated or front side of the tissue sheet and heat emitted from such printing elements is transferred through the tissue sheet and onto the bond sheet resulting in a transfer of some coating from the back side o the tissue sheet to the uncoated bond sheet and thereby producing an image or mark on both sheets. The image can be read from the front of both sheets in normal manner.

An alternate method of transferring the material fo the purpose of making a copy of the image or mark is to provide a coating of the improved thermochromic material on the front of the bond sheet, which sheet is placed rearward of the tissue sheet. The coating material is then sandwiched between the uncoated tissue sheet and the front surface of the bond sheet and the imaging is accomplished by transferring some of the coating from the bond sheet to the back side of the tissue sheet upon application of heat by thermal printing elements placed in contact or in extremely close proximity with the front of the tissue sheet.

The composition of the heat-sensitive coating consists of a thermochromic dye, a phenolic resin, a wax and a binding material of synthetic polyterpene. The polyterpene material is used as a binder in the coating and assumes a tacky condition when heated, which condition results in better adhesion to the receiving sheet upon the application of heat.

In view of the above discussion, the principal object of the present invention is to provide an improved thermal paper copy system.

Another object of the present invention is to provide a low-cost thermal copy system utilizing one coated paper or record sheet.

An additional object of the present invention is to provide an improved thermochromic coating material on one surface of a record sheet and in contact with a mating record sheet for enabling a thermal paper copy system.

A further object of the present invention is to provide a tissue sheet and a bond sheet along with the improved thermochromic coating sandwiched therebetween and reactive upon application of heat to provide imaging on both sheets.

Still another object of the present invention is to provide a thermochromic coating, having polyterpene as a binding ingredient thereof, and applied to one surface of one sheet of a two sheet copy system, which coating is heated to transfer the image to the uncoated sheet.

Additional advantages and features of the present invention will become apparent and fully understood from a reading of the following description taken together with the annexed drawing.

DESCRIPTION OF THE PREFERRED EMBODIMENT

Figure 1:
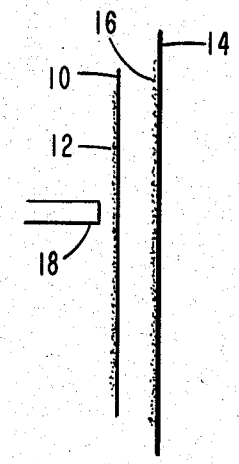
FIGS. 1 and 2 are diagrammatic views of thermal copy systems as exemplified in the prior art.
Figure 2:
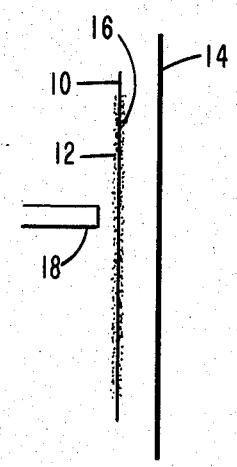

Referring to the drawing, FIGS. 1 and 2 show conventional two copy, thermal paper systems wherein each paper contains a coating on one surface thereof, FIG. 1, or the front paper contains a coating on both the front and back surfaces thereof, FIG. 2. In FIG. 1 a front sheet 10 includes a coating 12 on the face thereof and a back sheet 14 has a coating 16 on its front surface. A thermal print element 18 is positioned for marking or causing marking on the sheet 10 and enabling the carrying of the marking onto the sheet 14 by heating the coating 12 and imaging such marking on the coating 16. While sheets 10 and 14 are shown apart and separate from each other, both sheets are in actual practice in mating contact, and it is seen that the uncoated side of sheet 10 is against the coating 16 of sheet 14 and the coated side of sheet 10 against the print element 18. A conventional assembly is constructed with an arrangement wherein sheet 10 is a light weight, tissue-type, paper and the sheet 14 is a bond-type paper. In FIG. 2 the sheet 10 has the coating 12 on the front side and the coating 16 on the back side thereof, whereas the bond sheet 14 is uncoated. When the thermal print head 18 is energized, the heating of the coating 12 causes marking on the sheet 10 and the heat is carried through the tissue sheet to transfer some of the coating material 16 onto the sheet 14 resulting in both sheets being imaged to provide a readable two-copy system.

Figure 3:
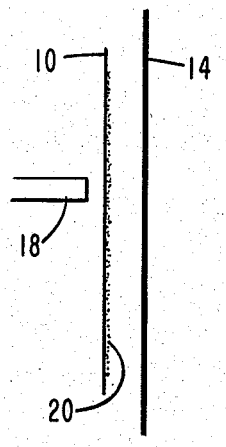
PRIOR ART FIG. 3
FIG. 3 is a diagrammatic view of a preferred thermal copy system of the present invention.

FIG. 3 illustrates in diagrammatic form the concept of the present invention wherein the tissue-type paper 10 adjacent the print head 18 includes an improved coating 20 on the back side thereof for mating with the front side of the uncoated bond paper 14. The heat from the print head 18 carries through the tissue sheet 10 causing transfer of some of the coating 20 onto the front of the bond sheet 14, with the result that an image or mark is produced on both sheets and both sheets are readable from the front sides thereof.

Figure 4:
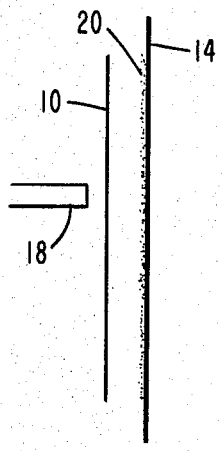
FIG. 4 is a diagrammatic view of a modified thermal copy system of the present invention.

FIG. 4 illustrates a modified system wherein the front sheet 10 is uncoated and the bond sheet 14 includes the improved coating 20 on the front surface. The coating 20 is sandwiched between the two sheets 10 and 14 and the imaging technique is accomplished during heating of the sheet 10 by transferring some of the coating 20 from the front surface of the bond sheet 14 onto the back surface of the tissue sheet 10.

Figure 5:
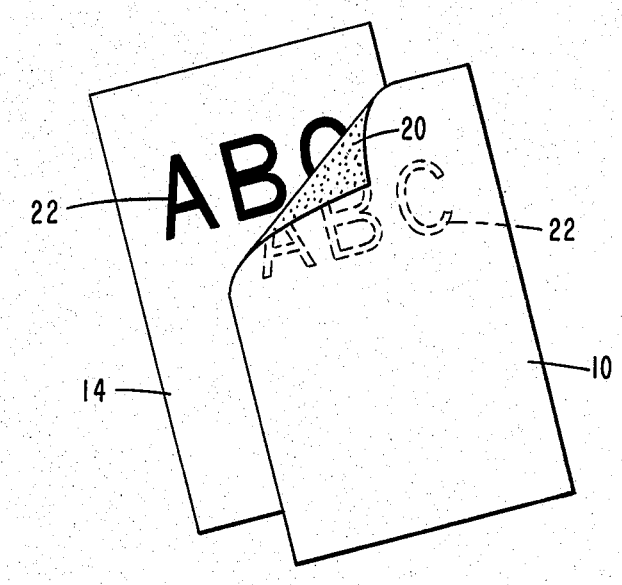
FIG. 5 is a diagrammatic view of the record sheets of FIG. 3 and showing the transfer of the thermal material.
Figure 6:
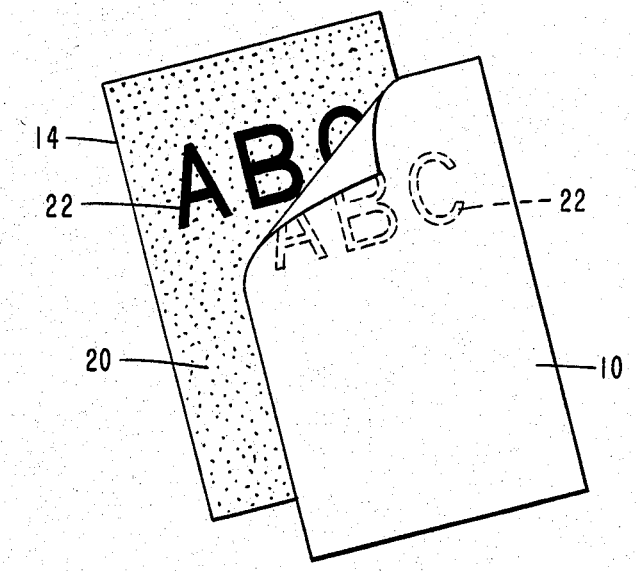
FIG. 6 is a diagrammatic view of the record sheets of FIG. 4 and showing the transfer of the thermal material.

FIG. 5 shows the tissue sheet 10 and the bond sheet 14 with the improved coating 20 on the back side of sheet 10 and the marking is transferred onto sheet 14 as an image 22 upon application of heat. In similar manner, FIG. 6 illustrates the improved coating 20 on the front surface of sheet 14 and transfer of a portion of the coating onto the back side of sheet 10 to accomplish the mark or image 22 thereon.

The present invention provides for applying and using the thermochromic coating on either the tissue sheet 10 or on the bond sheet 14 and transferring a portion of the coating 20 onto one or the other uncoated sheet upon actuating the heating element 18 during the imaging operation.

EXAMPLE I

Example I describes the method wherein a coating 20 of the thermochromic material is applied to the back surface of the translucent tissue sheet 10 and such sheet is mated or collated with the uncoated bond sheet 14 so that the coating material 20 is sandwiched between the front surface of the bond sheet and the rear surface of the tissue sheet, as illustrated in FIG. 3. The two sheets 10 and 14 are then imaged by the heating element 18 being placed in contact with the uncoated or front side of the tissue sheet 10. The heat from element 18 is transferred through the tissue sheet 10 and onto the bond sheet 14 resulting in some of the coating 20 being transferred from the back side of the tissue sheet and carried to the uncoated bond sheet, thereby producing an image on both sheets 10 and 14 which can be read from the front of each sheet in normal manner.

EXAMPLE II

Example II describes the method wherein a coating 20 of thermochromic material is applied to the front side of the bond sheet 14 and such sheet is mated or collated with the uncoated tissue sheet 10 so that the coating material 20 is sandwiched between the back surface of the tissue sheet and the front surface of the bond sheet, as illustrated in FIG. 4. The two sheets 10 and 14 are then imaged, as described in Example 1, except that the coating 20 is transferred to the translucent sheet 10 from the coated bond sheet 14.

COATING COMPOSITION

The thermochromic coating formulation consists of a thermochromic dye, a phenolic resin, one or more waxes and a binder. A preferred coating composition is as follows:

| Material | Trade Name | Percent Dry Weight |
|---|---|---|
| Crystal violet lactone | | 6.0 |
| Phenolic resin | Parabis | 28.0 |
| Ceresin wax | | 27.5 |
| Mixture of octa, hexa, penta, 9-octa decanamide | Armid HT | 27.5 |
| Synthetic Polyterpene | Wingtack 95 | 10.0 |
| Octadecyl 3,5-di-tert-butyl-4-hydroxy-hydracinnamate | Irganox 1076 | 1.0 |

A preferred phenolic material is formula 4,4′ isopropylidenediphenol having the trade name Parabis and of the structure

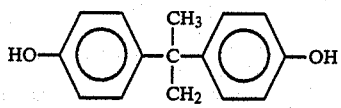

An alternate dye for use with the Parabis phenolic resin is 2'-analino-6'-diethylamino-3'-methyl fluoran having the trade name N102 and of the structure

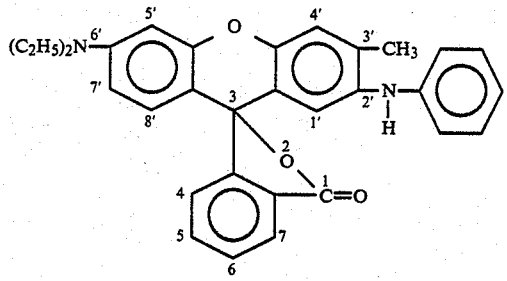

The synthetic polyterpene is mixed with the lactone and the resin and binds these materials into a composition which becomes tacky upon the application of heat. The tacky condition or characteristic of the bound coating influences and accelerates transfer of some of the coating to the mating sheet for good adherence thereto during the printing operation.

Referring back to the materials mentioned above in the coating composition, the thermochromic dye (crystal violet lactone or methyl fluoran) is available from Hilton-Davis Company, Cincinnati, Ohio. The phenolic resin, sold under the trade name Parabis, is available from Dow Chemical Company, Midland, Michigan. The ceresin wax or a similar ozokerite mineral wax are readily available products. The decanamide mixture is an amide wax sold under the Armid HT trade name by Armak Chemical Division, Chicago, Illinois. The polyterpene is available as Wingtack 95 from Goodyear Chemical Company, Akron, Ohio. And, the cinnamate is an anti-oxident available under the trade name Irganox 1076 from Ciba-Geigy, New York, New York.

The polyterpene in the coating composition and in the appropriate percentage of the total weight thereof, as noted in the above table of materials, is formulated to provide the best mode for carrying out the invention. It is noted that the first above-mentioned Baum disclosure includes a binder of polyvinyl alcohol which provides a relatively non-tacky coating on the support sheet, and that the second above-mentioned Baum disclosure includes a finely-divided plasticizer and a butylene which provide a relatively high tackified coating that remains tacky for a period measured in tens of minutes to enable making successive copies. The coating composition or formulation of the present invention provides a tackified condition of a predetermined and precise nature in an area or range between a non-tacky condition and an extremely tacky condition. The polyterpene enables the transfer of the dye material from one sheet to the other sheet at low energy levels by reason of the herein-disclosed and preferred tackified coating that results in good adhesion to the receiving sheet upon the application of heat during the printing operation. The present invention thus utilizes one coated sheet to provide a process for obtaining two copy printing or imaging of characters.

It is thus seen that herein shown and described is a multiple copy record system that utilizes an improved temperature-sensitive coating on one surface of a record sheet. The coating is sandwiched between the one surface and a surface of another sheet and applied heat to the coating causes imaging on the record sheet and transfer of a portion of the coating to effect imaging on the other sheet. The polyterpene binder in the coating provides a low cost and tackified formulation for one-surface coating in producing a two copy system. The present invention enables the accomplishment of the objects and advantages mentioned above, and while a preferred embodiment and a modification of the invention have been disclosed herein, other variations may occur to those skilled in the art. It is contemplated that all such variations and modifications not departing from the spirit and scope of the invention hereof are to be construed in accordance with the following claims.

What is claimed is:

1. A thermal-sensitive sheet copy system for use with at least one thermal printing element for initiating an image and forming a copy thereof, said copy system comprising a first sheet having a coating on the back thereof, and a second sheet rearward of and in contact with the coating on the first sheet, said coating including crystal violet lactone thermochromic dye of about 5–7% by weight, a wax of about 26–30% by weight and 4,4' isopropylidenediphenol phenolic resin of about 26–30% by weight mixed in a binding of about 10% polyterpene resin material wherein the image initiated by the thermal printing element is the coating on the first sheet becomes tacky when heated at low energy levels and causes transfer and adherence of a portion of the coating of the initiated image to the second sheet thereby producing a multiple-copy image during a printing operation.

2. The system of claim 1 wherein the first sheet is a translucent sheet.

3. The system of claim 1 wherein the second sheet is a bond sheet.

4. The system of claim 1 wherein the relative amount of polyterpene to the dye and phenolic material is 25% to 35% by weight.

5. In a temperature responsive, multiple copy imaging system having a base sheet and a recipient sheet and coating material on the base sheet comprising a mixture of microscopic particles of crystal violet lactone of about 5–7% by weight, at least one wax of about 26–30% by weight and 4,4' isopropylidenephenol phenolic resin of about 26–30% by weight which mixture is solid at room temperature and meltable upon heat activated reactive contact, the improvement comprising having the lactone, the wax and the phenolic resin bound in a mixture of about 10% polyterpene resin which becomes adhering when heated at low energy levels wherein a portion of the coating is transferred from the base sheet to the recipient sheet to provide two copies during an imaging operation.

6. In the system of claim 5 wherein the relative amount of polyterpene to lactone and phenolic material is 25% to 35% by weight.

7. A heat-sensitive multiple copy system for use with thermal printing means, said copy system comprising a pair of sheets positioned in collated manner, one of said sheets having a coating of thermochromic material on one surface thereof and sandwiched between the sheets, the heat from the thermal printing means effecting an image in the coating of thermochromic material and transferring a portion of the coating material from the surface of one sheet to the surface of the other sheet to provide an image on each sheet during a printing operation, said coating including 2'-analino-6'-diethylamino-3'-methyl fluoran or crystal violet lactone thermochromic dye of about 5–7% by weight, a mineral wax of about 26–30% by weight and 4,4' isopropylidenediphenol phenolic resin of about 26–30% by weight mixed in a binding of about 10% polyterpene resin material which becomes tacky when heated at low energy levels thereby causing adherence of a portion of the coating material and transfer of the image to the uncoated sheet.

8. The system of claim 7 wherein one of the sheets is a translucent sheet having the coating of thermochromic material thereon.

9. The system of claim 7 wherein one of the sheets is a bond sheet having the coating of thermochromic material thereon.

10. The system of claim 7 wherein the relative amount of polyterpene to the dye and phenolic material is 25% to 35% by weight.

* * * * *